US007775525B2

(12) United States Patent
Staver et al.

(10) Patent No.: US 7,775,525 B2
(45) Date of Patent: Aug. 17, 2010

(54) GAME, METHOD OF MANUFACTURE, AND METHOD OF USE

(75) Inventors: Michael Staver, Kewaskum, WI (US); Lance White, West Bend, WI (US)

(73) Assignee: CS Industries, Inc., West Bend, WI (US)

( * ) Notice: Subject to any disclaimer, the term of this patent is extended or adjusted under 35 U.S.C. 154(b) by 907 days.

(21) Appl. No.: 11/475,830

(22) Filed: Jun. 27, 2006

(65) Prior Publication Data

US 2007/0001399 A1 Jan. 4, 2007

Related U.S. Application Data

(60) Provisional application No. 60/694,705, filed on Jun. 27, 2005, provisional application No. 60/713,037, filed on Aug. 31, 2005, provisional application No. 60/760,844, filed on Jan. 20, 2006, provisional application No. 60/781,990, filed on Mar. 14, 2006.

(51) Int. Cl.
*A63B 67/00* (2006.01)
*A63F 9/02* (2006.01)

(52) U.S. Cl. ..... 273/317.5; 273/317.1; 273/317.2; 273/317.3; 273/317.6; 273/398; 273/400; 273/401; 273/402

(58) Field of Classification Search ..... 273/398, 273/400–402, 317.1–317.5, 108, 118 R
See application file for complete search history.

(56) References Cited

U.S. PATENT DOCUMENTS 469,554 A * 2/1892 Favor ..... 273/401
970,881 A * 9/1910 Cadwallader ..... 273/317.6
2,520,460 A * 8/1950 Ford ..... 124/7
2,873,969 A * 2/1959 Ziel ..... 473/456
3,100,642 A * 8/1963 Goldstein ..... 206/579
3,844,558 A * 10/1974 Gigliotti ..... 273/317.2
3,856,298 A * 12/1974 Frantti ..... 473/446
3,899,173 A * 8/1975 Zaris ..... 273/317.3
4,323,250 A * 4/1982 Lansberry ..... 273/400
4,373,724 A * 2/1983 Shoglow ..... 273/317.6
4,492,380 A * 1/1985 Saytar ..... 473/471
5,110,127 A * 5/1992 Potter ..... 273/317.3
5,238,243 A * 8/1993 Grispi ..... 473/446
5,282,635 A * 2/1994 Hopkins ..... 273/342

(Continued)

*Primary Examiner*—Raleigh W. Chiu
(74) *Attorney, Agent, or Firm*—Kaplan Gilman & Pergament LLP

(57) ABSTRACT

A manual game is provided which simulates American football. The game has a playing surface with multiple openings having indicia associated with football activities, and players toss game pieces at the surface in order to achieve football action determined by the indicia of the opening into which a game piece drops. The game includes a goal the structure with a pair of uprights, and players attempt to score field goals and points after touchdown by tossing a game piece between the uprights. A plurality of template plates are provided to effect different games, and each template plate has a subset of the openings and covers at least one of them. As a result, different games are available with different patterns of openings. A blank, planar form is provided which can be folded and assembled into a game chassis which includes the playing surface. The form is made of an inexpensive sheet material which can be manufactured easily, and it is of such a configuration that it can be assembled easily by individuals of ordinary skill.

11 Claims, 13 Drawing Sheets

U.S. PATENT DOCUMENTS 5,320,360 A * 6/1994 St. Pierre ..... 273/402
5,332,230 A * 7/1994 Benedict ..... 473/594
5,333,865 A * 8/1994 Holmes ..... 273/317.5
5,333,879 A * 8/1994 Barnes ..... 273/400
5,509,650 A * 4/1996 MacDonald ..... 473/446
5,765,832 A * 6/1998 Huff ..... 273/354
5,967,513 A * 10/1999 Wells ..... 273/108.1
6,070,879 A * 6/2000 Kemp ..... 273/317.5
2007/0001399 A1 * 1/2007 Staver et al. ..... 273/317.3
2009/0174145 A1 * 7/2009 Staver et al. ..... 273/317.5

* cited by examiner

GAME, METHOD OF MANUFACTURE, AND METHOD OF USE

RELATED APPLICATIONS

The present patent application claims the priority of, and incorporates by reference the entirety of each of, the following U.S. provisional patent applications: No. 60/694,705, filed Jun. 27, 2005; No. 60/713,037, filed Aug. 31, 2005; No. 60/760,844, filed Jan. 20, 2006; and No. 60/781,990, filed Mar. 14, 2006.

BACKGROUND OF THE INVENTION

The present patent application relates generally to manually played games and, more particularly, concerns games involving dropping of game pieces, or the like, into scoring areas.

With the soaring popularity of sports action computer games, manual games have suffered a steep decline. However, manual games offered training in hand-eye coordination and certain athletic skills that is just not available from operating computer controllers. A form of manual game that was popular in amusement arcades involved rolling a ball down an alley which ended in an upward ramp that launched the ball towards a playing surface with openings dimensioned to receive the ball. Different openings were associated with different point values (positive and negative), allowing the player to accumulate a score by playing a fixed number of balls. As entertaining as such a game might be, it lacked the attraction and excitement of sports which are currently popular, and a game of this type which would be useful would be far too expensive for home use.

It is therefore an object of the present invention to provide a manual game which incorporates the physical realism of popular sports. In particular, sports such as football, basketball, soccer and golf are specifically contemplated.

It is another object of the present invention to provide a manual game with sufficient versatility to simulate multiple sports.

It is yet another object of the present invention to provide a manual game which is simple and inexpensive in construction, can be assembled readily by a person of ordinary skill, and can be played by individuals of all ages.

SUMMARY OF THE INVENTION

In accordance with one aspect of the present invention, a manual game is provided which simulates American football. The game has a playing surface with multiple openings having indicia associated with football activities, and players toss game pieces at the surface in order to achieve football action determined by the indicia of the opening into which a game piece drops. The game includes a goal structure with a pair of uprights, and players attempt to score field goals and points after touchdown by tossing a game piece between the uprights.

In accordance with another aspect of the present invention, a manual game is provided which has multiple openings in a playing surface, and the game involves players tossing game pieces into the openings. A plurality of template plates are provided to effect different games, and each template plate has a subset of the openings and covers at least one of them. As a result, different games are available with different patterns of openings.

In accordance with another aspect of the invention, a blank, planar form is provided which can be folded and assembled into a game chassis which includes a playing surface with multiple openings into which a game piece may be tossed. The form is made of an inexpensive sheet material which can be easily manufactured, and is of such a configuration that it can be assembled easily by individuals of ordinary skill.

BRIEF DESCRIPTION OF THE DRAWINGS

The foregoing brief description and further objects, features and advantages of the present invention will be understood more completely from the following detailed description of presently preferred, but nonetheless illustrative, embodiments in accordance with the present invention, with reference being had to the accompanying drawings, in which.

DETAILED DESCRIPTION OF THE PREFERRED EMBODIMENTS

Figure 1:
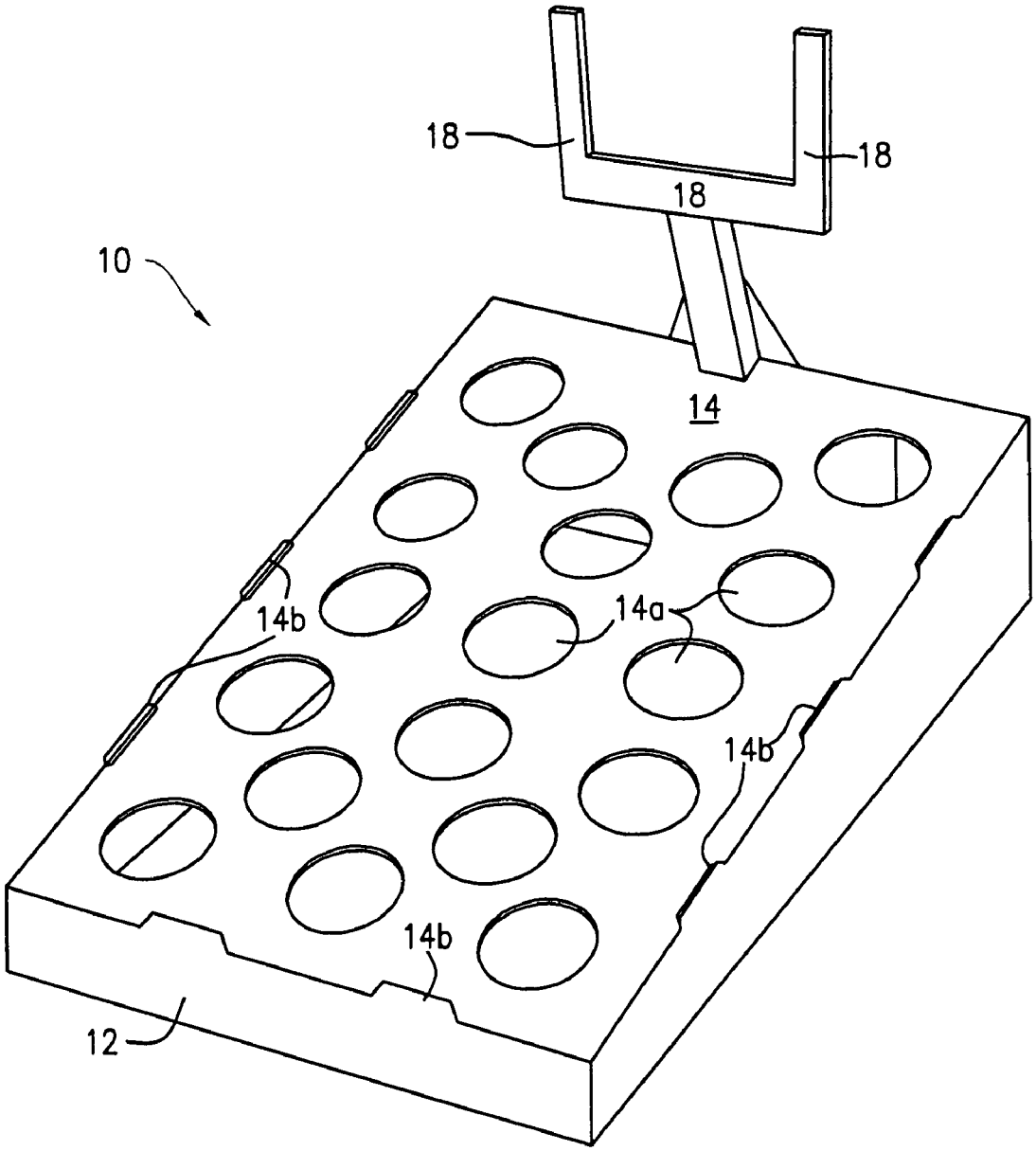
FIG. 1 is a perspective view of a first embodiment of a game chassis in accordance with the present invention.
Figure 2:
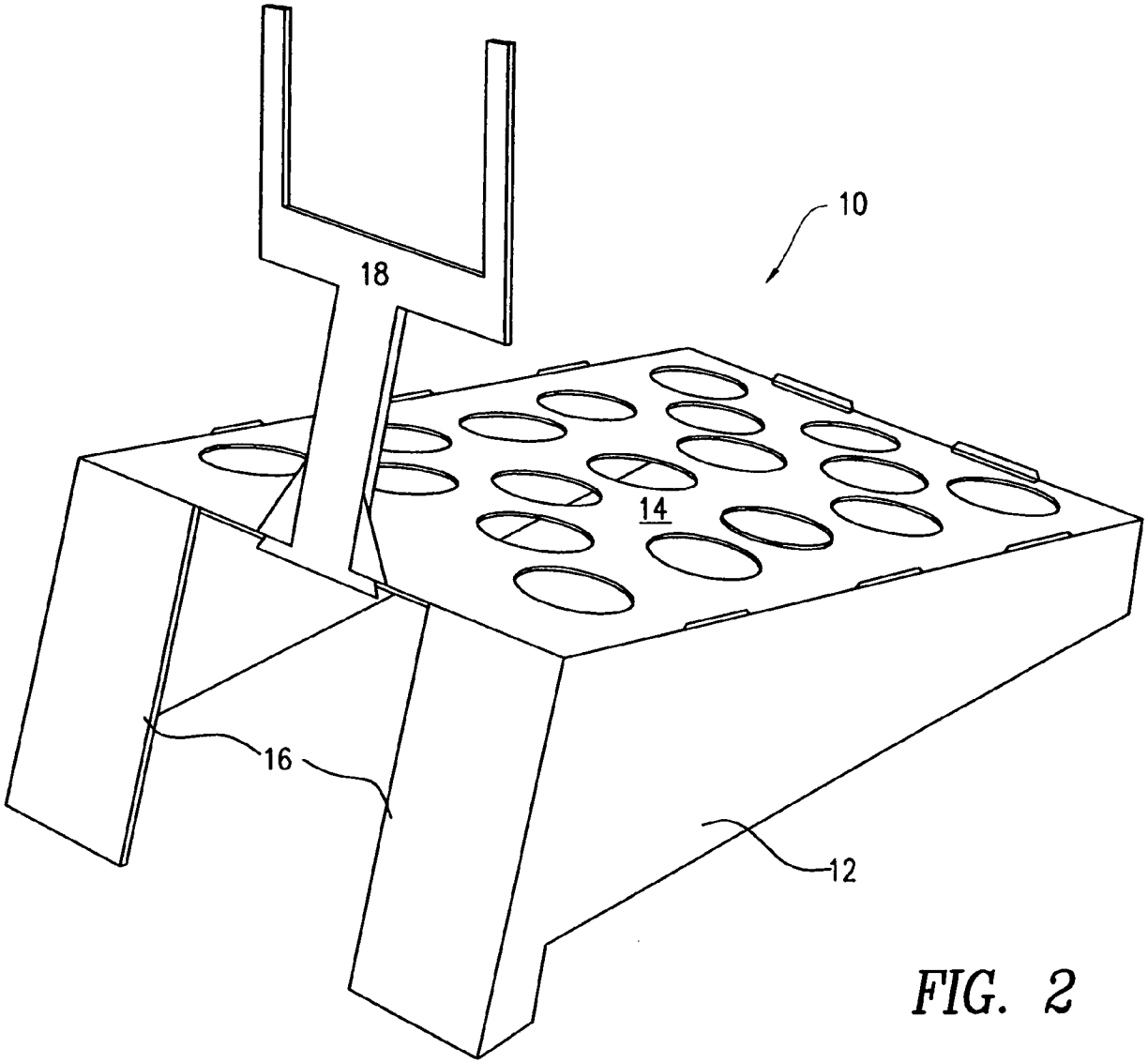
FIG. 2 is a rear perspective view of the game chassis of FIG. 1.

Turning now to the drawings, FIG. 1 is a perspective view of a first embodiment 10 of a game chassis in accordance with the present invention, and FIG. 2 is a rear perspective view thereof. The game broadly comprises a hollow, generally wedge-shaped body 12 having a top surface 14 which slopes forward and downward as a result of the wedge-shape. In addition, body 12 is formed with a pair of rear legs 16, 16 which raise the rear of body 12 further above a supporting surface than the front, causing surface 14 to have an increased slope. Surface 14 has a plurality of generally circular openings 14*a*, in the preferred embodiment, 18 openings. At the rear of body 12, there is provided an upright goal structure 18 which has the appearance of a football goal with uprights 18*a*, 18*a*.

Along either side and its front edge, surface 14 includes a plurality of upstanding walls 14*b*. These walls are constructed to permit a template plate 40 to be placed on top of surface 14 and to be retained in position by the upright walls 14*b*. In the preferred embodiment, a plurality of such template plates 40-1 through 40-n are provided and include a subset of the holes 14*a* provided on surface 14, thereby masking the excluded holes. As a result, different template plates may be placed upon surface 14 so as to modify the number and configuration of openings 14*a* which are exposed. As explained further below, this permits the game to be modified so as to permit different games to be placed.

Those skilled in the art will appreciate that walls 14*b* could be replaced by small upright projections or any other form of fixation may be used for the plates 40-1 through 40-n, such as small hook-and-pile fasteners of the type known in the trade under the trademark "Velcro".

Figure 3:
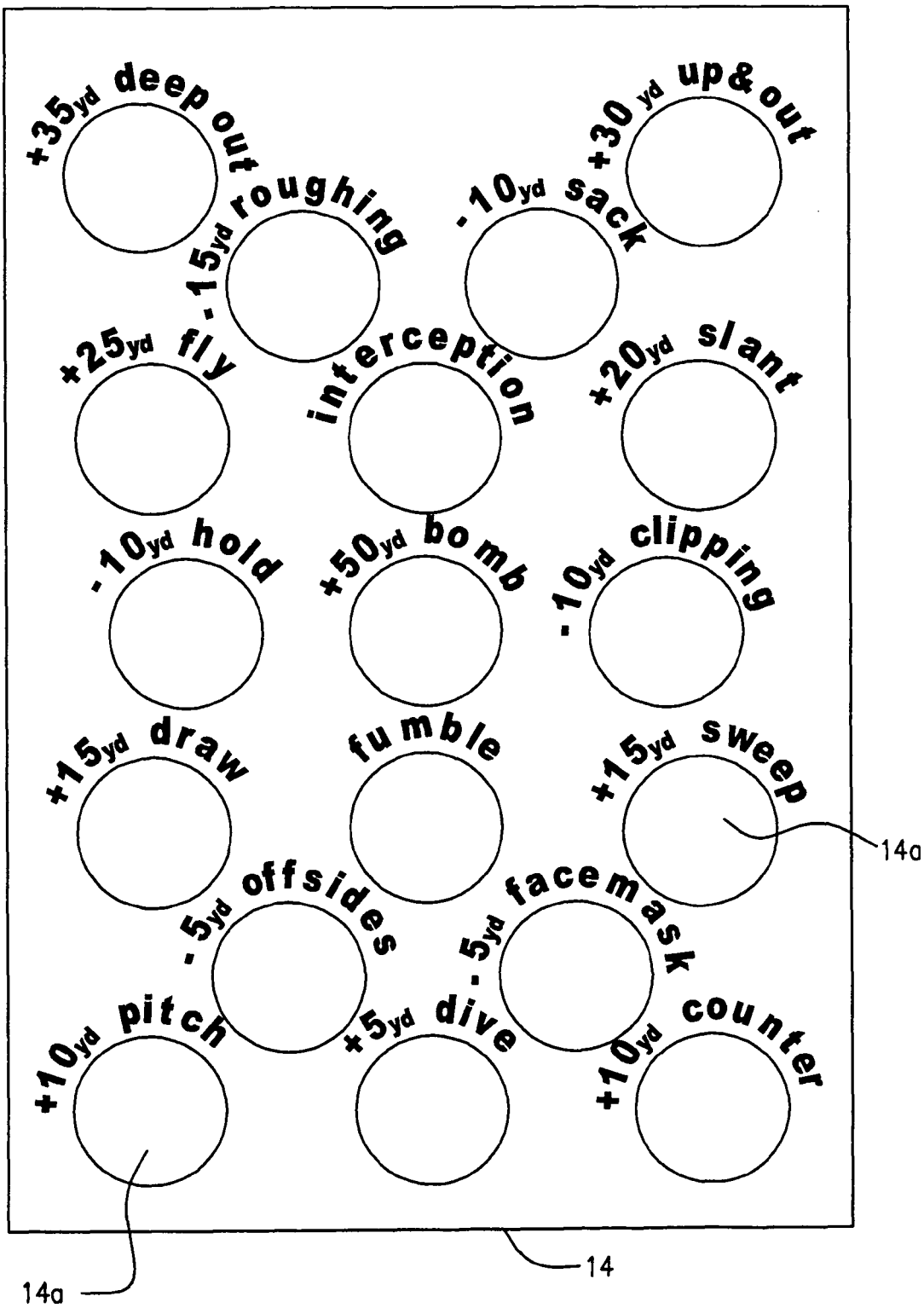
FIG. 3 is a plan view of the playing surface of the game chassis of FIGS. 1 and 2

The embodiment illustrated in FIGS. 1 and 2 is intended to be a football game. Accordingly, surface 14 is preferably provided with indicia related to football activities, as illustrated in FIG. 3, which is a plan view of surface 14 with all indicia on it. It should be noted that each opening is associated with the result of running a play in football. For example, the upper right hand opening corresponds to "30 yard up and out" and the opening immediately below corresponds to "20 yard slant." Similarly, the upper left hand opening corresponds to "35 yard deep out" and the opening immediately below corresponds to "25 yard fly." In between these four openings, there are three openings which correspond to negative results, such as a "15 yard roughing penalty," a "10 yard sack," and an "interception." The central opening has the highest value ("50 yard bomb") and is surrounded by openings corresponding to negative results. Similarly, the lower right hand opening is a "10 yard counter", and the opening immediately above is a "15 yard sweep." The lower left hand opening is a "10 yard pitch" and the opening immediately above is a "15 yard draw." The lower middle opening is a "5 yard drive," but the openings immediately above it all correspond to negative results. The close proximity of negative results to positive ones introduces an element of risk and excitement. Those skilled in the art will appreciate that the indicia indicated in FIG. 3 may be provided directly on surface 14, or they may be placed upon one of the template plates 40-1 through 40-n. It is also to be anticipated herein that other and different configurations can be used for the indicia related to the openings, but preferably maintaining the positive and negative results in close correspondence to each other.

The disclosed embodiment of game chassis 10 is preferably about 10 inches long, 6 inches wide and 4 inches high at the highest point, with a goal post assembly 18 extending upward an additional 4.5 inches. The goal post opening is preferably 2¼ inches square and each of the openings 14*a* is preferably about one inch in diameter. At the front, surface 14 is preferably about an inch above the surface on which the chassis stands. A game of this size can conveniently be used on a tabletop with the players standing 4-5 feet away. Each player is provided with a number of game playing pieces, which may be a coin, a token, a puff, a beanbag, or the like.

Figure 11:
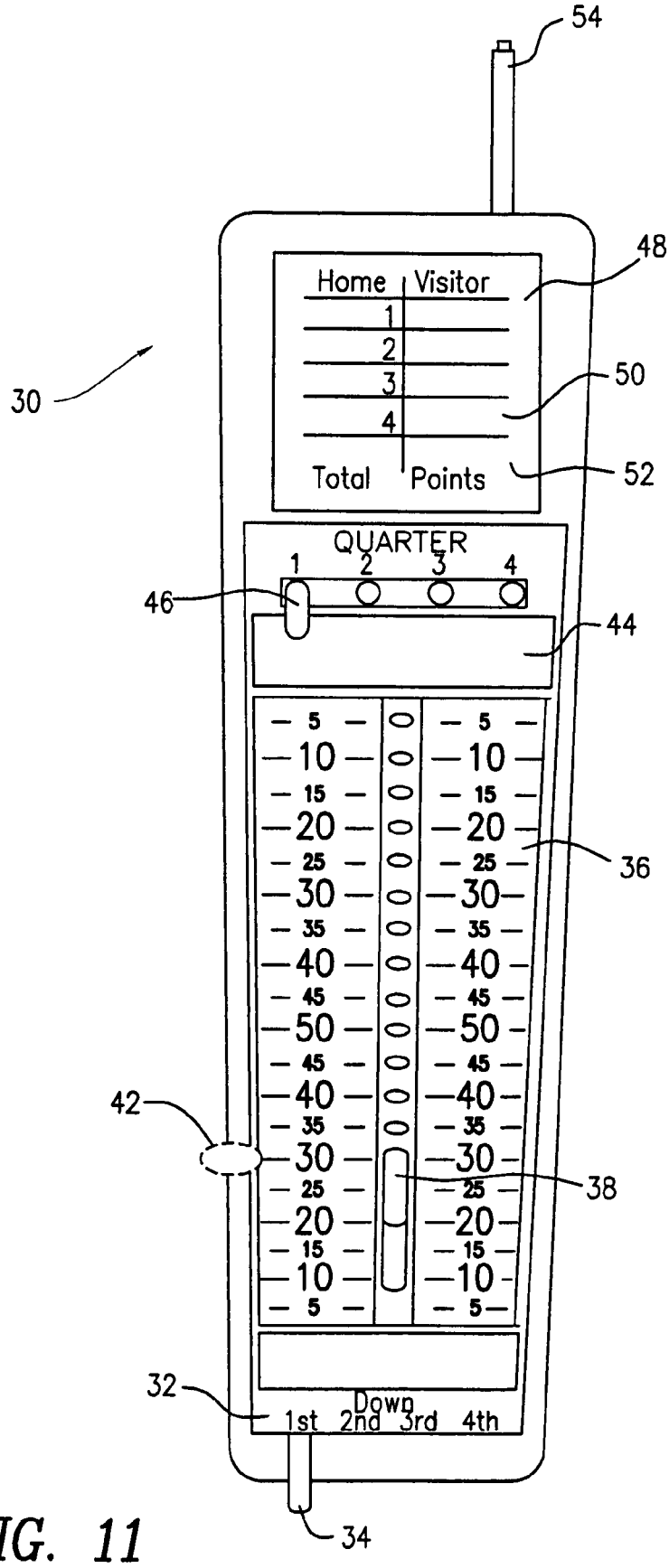
FIG. 11 is a front view of a preferred scoreboard element.

The game also includes a scoreboard element 30 as shown in FIG. 11. In this embodiment, the scoreboard is related to football scoring. Accordingly, there is provided a down marker 32 with a slide 34 which is moved to indicate the down for the team in possession of the ball. As it may be seen, there are four predetermined positions for slide 34 corresponding to first, second, third, and fourth down. Above the down marker 32 there is provided a field position marker 36 which has a slide 38, which moves vertically, to indicate the position of the ball on the field. At the side of the position marker, there is also provided a slide 42 which marks the first down position, that is, the position on the field that must be reached by a player in order to achieve a first down. Above the position marker, there is a quarter marker 44 having a horizontal slide 46 with four marked positions indicating the first, second, third, and fourth quarters. Above the quarter marker, there is an erasable score area 48 having columns for the home team and visitor. The score is maintained in real time, and four separate lines 50 are provided for respective quarters. At the bottom of the area 48, is provided a "total" line 52 into which a final score is written. The preferred embodiment also includes a pen 54, which is inserted is a channel in element 30.

Play begins with a coin toss, the winner of which can decide whether he wishes to be the home team or the visitor. The visitor team will receive first. Then, the home team takes his position at the toss line and the field position marker 36 is set at his 20 yard line, and the first down slide is positioned at the 30 yard line. Thereafter, the home team will toss one of the game pieces at the game chassis 10 in an effort to have it drop into one of the holes in the surface 14. The field position marker is then adjusted in relationship to the hole into which the playing piece falls. For example, if a playing piece falls into the lowest center hole, the field position marker is advanced by 5 yards. The down marker is similarly advanced by one. If the playing piece does not drop into any of the holes, only the down marker is advanced. A player is given four opportunities to reach or pass the position of the first down slide 34, with the down marker being incremented after each attempt. If a player achieves a first down, the down slide 34 is reset to its original position, giving the player an additional four downs. If the player fails to achieve a first down, "possession" of the ball changes and the other player steps to the toss line. At that point, both the field position slide 38 and the first down slide 40 are moved in the opposite direction.

Scoring occurs when the field position slide 38 reaches one of its extreme ends. If a player reaches the extreme end of slide 38 at his own (starting) end of the field (i.e., 0 yards) a "safety" (and possession) is awarded to the other player and two points are added to his score. If a player reaches the extreme of the slide 38 opposite his starting and (i.e., 100 yards), he scores a touchdown and six points are added to his score. After a player scores a touchdown, he is given the opportunity to "kick" for an extra point, or if he has reached or passed the 30-yard line on the opposite side of the field, he may attempt to "kick" a field goal. In order to attempt the "kick" a player steps to the kick line which is, preferably, one foot closer to the game chassis 10 and attempts to toss a game piece between the two uprights 18 comprising the goal 18. The player who is successful in a kick after a touchdown is awarded one point and a player who is successful in a field goal attempt is awarded three points. The players toss position for a field goal is determined by the position of the field position slide 38. For every 10 yards closer than the 30-yard line, the player may step forward six inches.

If he chooses, a player may try for a 2-point conversion instead of a kick after a touchdown. If he wishes to try for a 2-point conversion, he must state so after scoring a touchdown and must then toss a playing piece from the normal toss position. He will score two points if the playing piece falls into any opening on surface 14 with a positive yardage value.

After a player scores, the other player will assume possession and begin play from his own 20-yard line. The one exception is that after scoring a safety, a player retains possession and begins play from his own 20-yard line.

Preferably, a quarter will end after each player has had two possessions. However, the players may agree that a game will be timed. For example, the players may agree that a game will take twenty minutes and that each quarter will last five minutes. The third quarter will begin with the visitor having possession.

One overtime period will be available if, at the end of the fourth quarter, the teams are tied. A coin toss determines which team goes first, and the first team to score in overtime wins.

Figure 4:
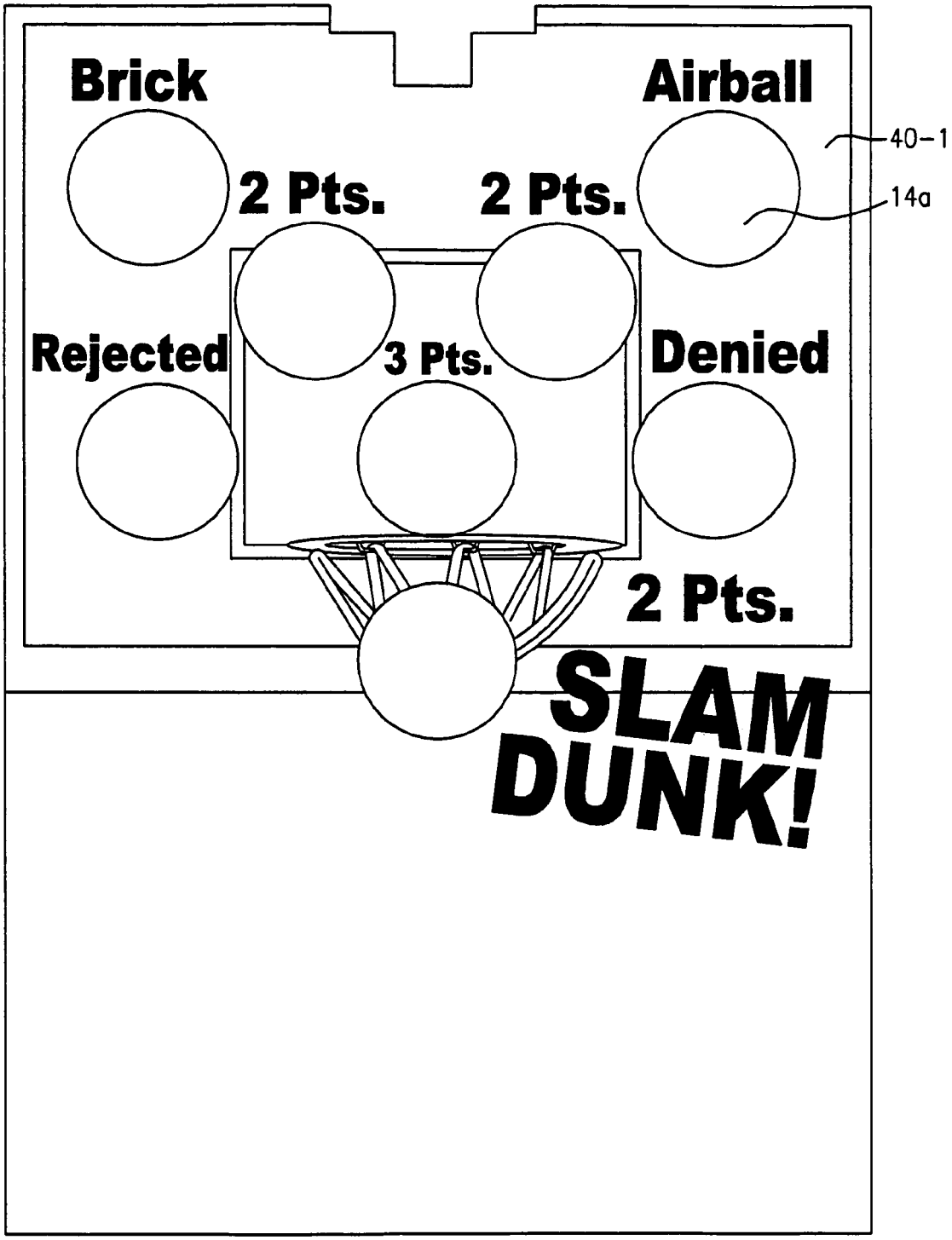
FIGS. 4-8 are plan views of overlay templates useful with the game chassis of FIG. 1 to create a basketball game, a soccer game, a golf game, an auto racing game, and a general tossing game, respectively.

It is contemplated that the present embodiment would permit different games to be played by simply overlaying a template 20-1 through 20-n on surface of 14 of game chassis 10, in order to change games. For example, FIG. 4 illustrates an overlay template 40-1, which permits a game of basketball to be played. In this case, template 40-1 exposes only eight of the openings 14*a* in surface 14. In this case, the indicia at the openings correspond to basketball events. This game is preferably played by two players, but it may be played by one player for practice. The players will toss a coin to determine which one goes first. That player positions himself at the tossing line and begins play by tossing a game piece at the game chassis 10. If the game piece goes into one of the openings corresponding to a point score, he is awarded that many points, and gets another opportunity to toss a game piece. If a player fails to score points on a game piece toss, the other player steps up to the tossing line and begins tossing game pieces. The first player to reach a score of 21 the wins. Alternatively, the players could toss alternately. Another variation of the game would be that the first player attempts a shot of his choice. If he misses the shot, the second player has the opportunity to attempt a shot of his choice. If a player makes a shot of his choice, the other player must immediately make the same shot or the successful player wins a point. The first player to score an agreed number of points, for example five, is the winner.

Figure 5:
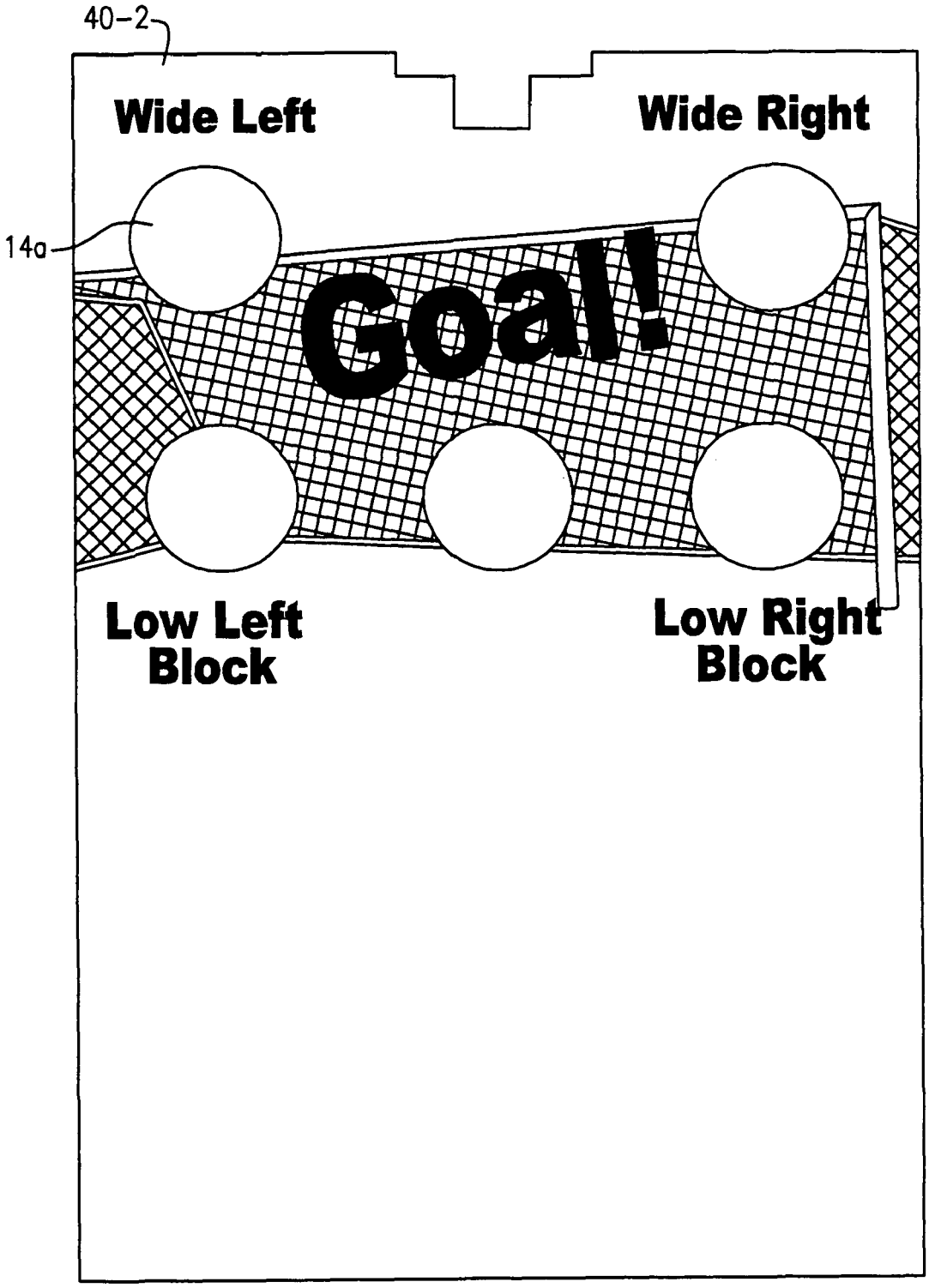

FIG. 5 illustrates an overlay template 40-2 which emulates playing a game of soccer. In this case, template 40-2 exposes only five of the openings 14*a* in surface 14, and the indicia at the openings correspond to soccer events. Preferably, the game is played by two players, but one player may play for practice. The players will toss a coin to determine which one goes first. That player positions himself at the tossing line and begins play by tossing a game piece at the game chassis 10. The only way he can score is if the game piece falls into the middle opening in the lower row. The player can continue to toss game pieces as long as the game piece falls into the goal opening, and he is awarded one point for each goal. As soon as he misses the goal, it is the other player's turn. The first player to score 10 goals is the winner.

Figure 6:
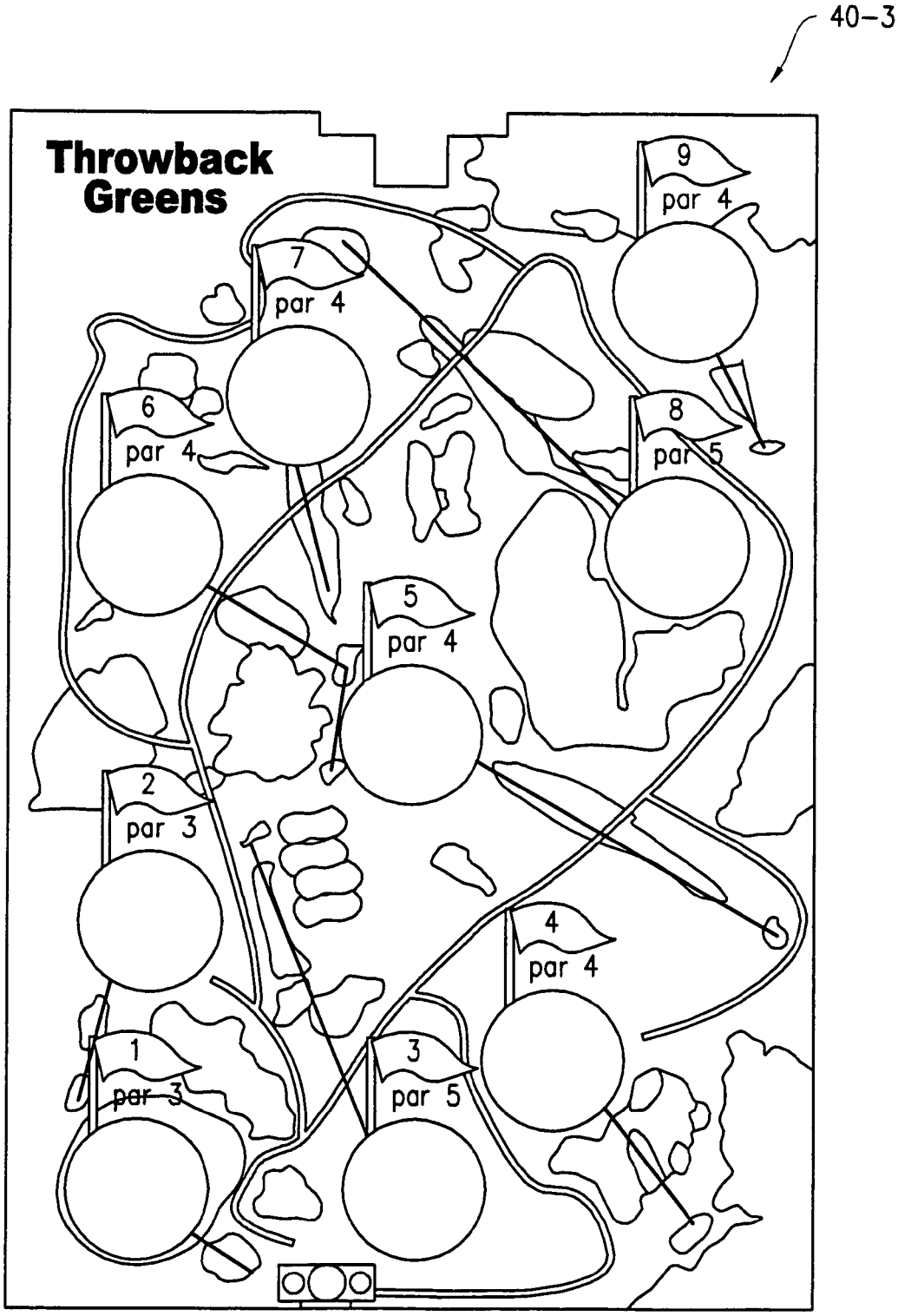

FIG. 6 illustrates an overlay template 40-3 which emulates playing a game of golf. In this case, template 40-3 exposes only nine of the openings 14*a* in surface 14. In this case, the indicia at the openings correspond to golf events. Preferably, the game is played by two players, but one player may play for practice. The players will toss a coin to determine which one goes first. That player positions himself at the tossing line and begins play by tossing a game piece at the game chassis 10. In his first turn, he must drop the game piece into whole 1. He must keep tossing at hole 1 until the game piece goes in. His score for that hole will be the number of tosses necessary for a game piece to go in. Next, the other player attempts to toss a game piece into hole 1, and his score for that hole will be the number of attempts necessary. The nine holes are played in order, with each player getting a score for each hole, and the winner of the game is the one with the lowest total score.

Figure 7:
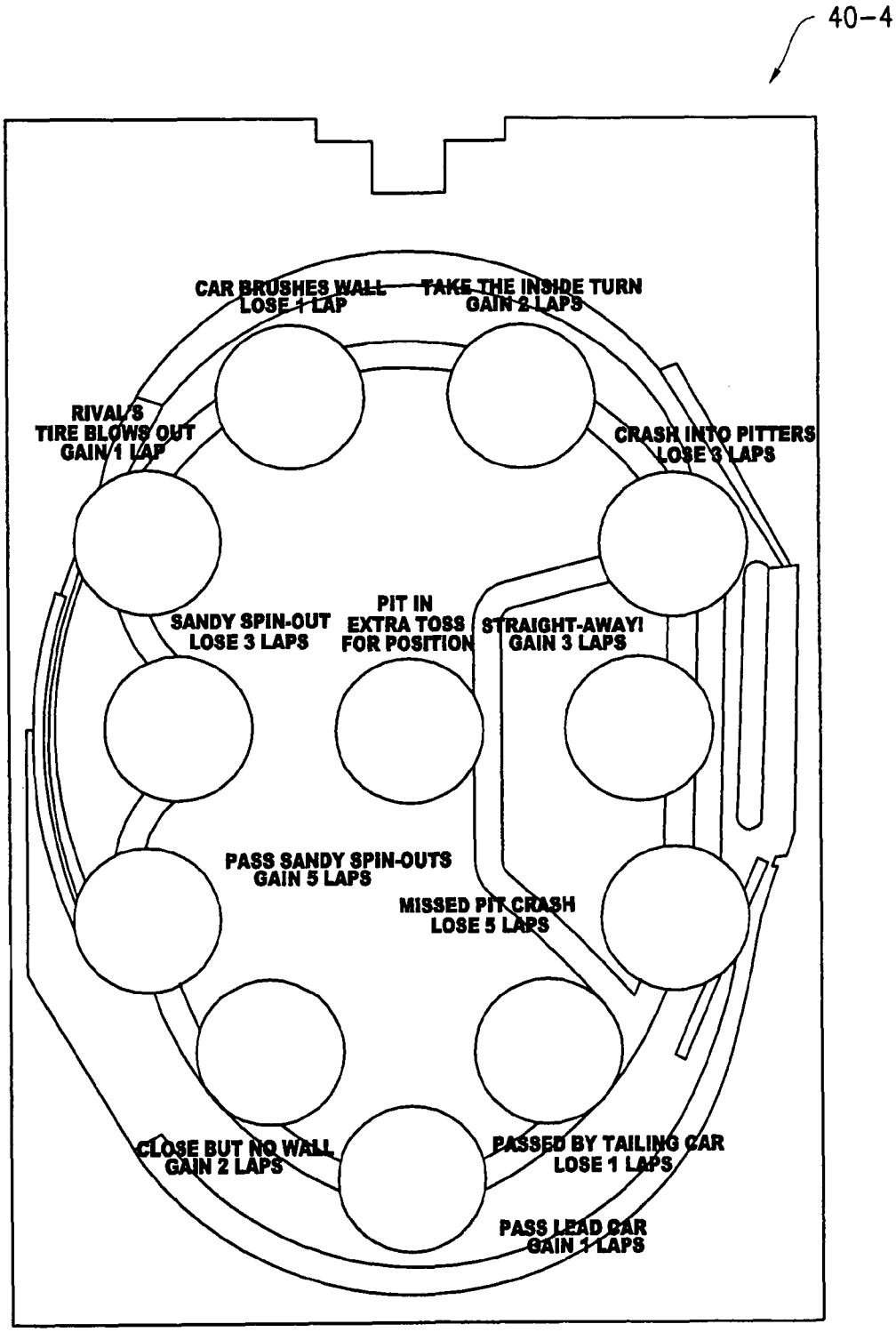

FIG. 7 illustrates an overlay template 40-4 which emulates auto racing. In this case, template 40-4 exposes only twelve of the openings 14*a* in surface 14, and the indicia at the openings correspond to auto racing events. Preferably, the game is played by two players, but one player may play for practice. The players will toss a coin to determine which one goes first. That player positions himself at the tossing line and begins play by tossing a game piece at the game chassis 10. Thereafter, the other player will toss, and the players will take turns tossing. Depending upon the opening into which the game piece falls, the players will gain or lose laps. Any player whose game piece drops into the center opening is awarded an additional toss. No player's accumulated laps can ever be less than zero. The first player to reach 10 laps is the winner.

Figure 8:
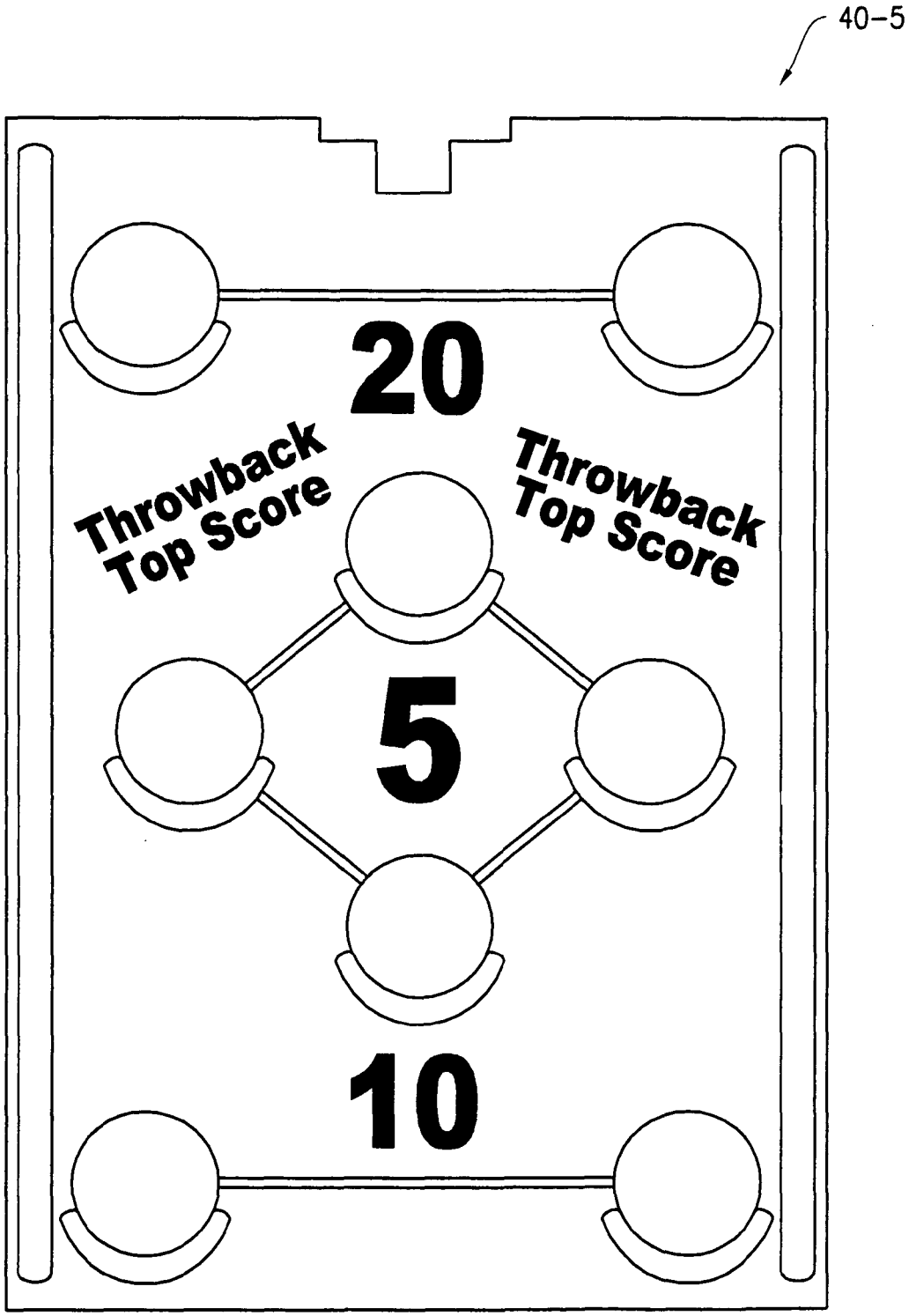

FIG. 8 illustrates an overlay template 40-5 which provides a general toss game. In this case, template 40-5 exposes only eight of the openings 14*a* in surface 14, and the indicia at the openings correspond to points, there being two openings at the top valued at 20 points each, two openings at the bottom valued at 10 points each, and four central openings and a diamond pattern valued at five points each. Preferably, the game is played by two players, but one player may play for practice. The players will toss a coin to determine which one goes first. That player positions himself at the tossing line and begins play by tossing a game piece at the game chassis 10. Thereafter, the players take turns tossing. If a game piece drops into an opening, the tossing player is awarded that number of points. The first player to reach an agreed score, say 100 points, is the winner.

Figure 9:
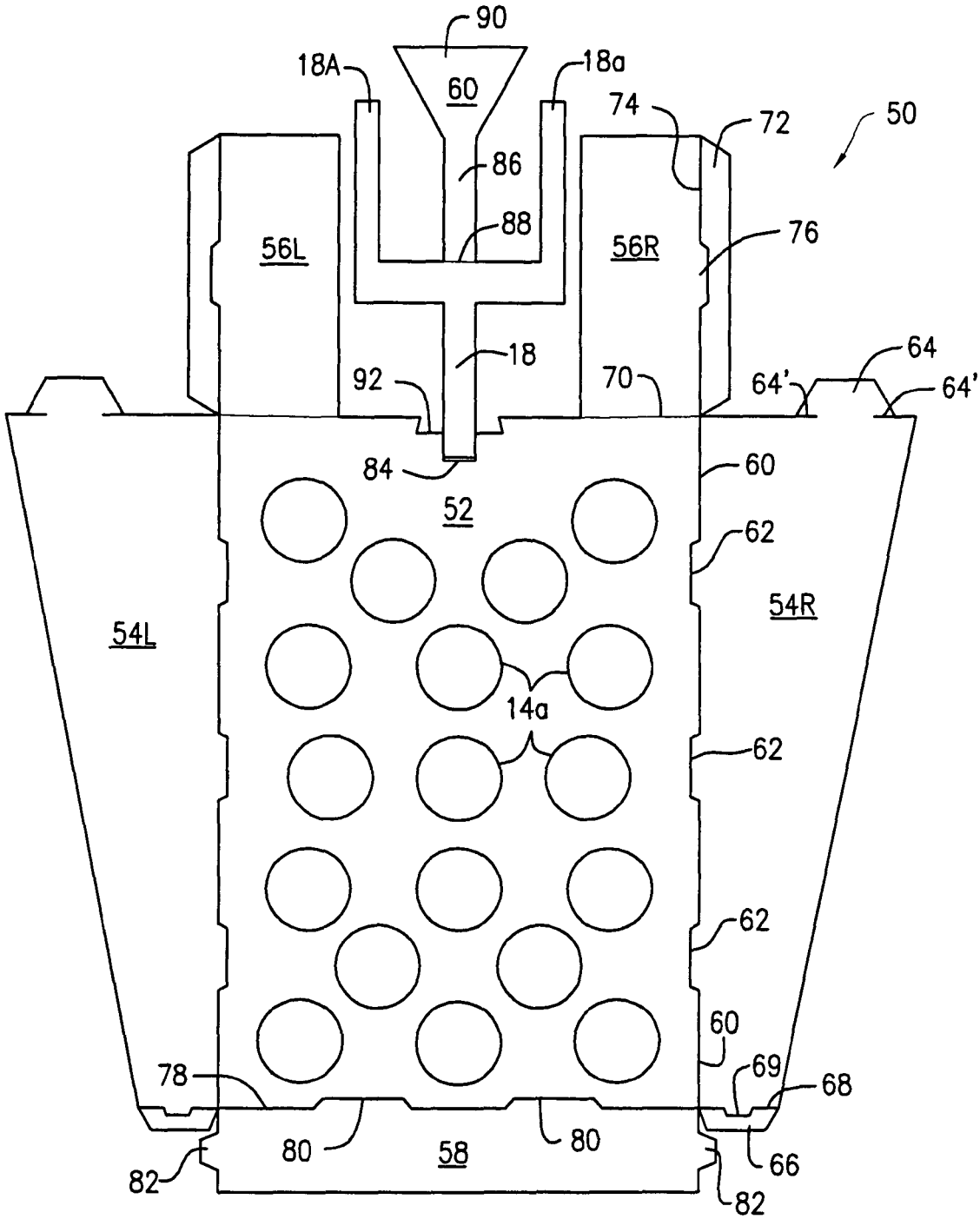
FIG. 9 is a plan view of a form useful in manufacturing the game chassis of FIG. 1.

Game chassis 10 is preferably made of cardboard or corrugated cardboard, but it may be made of any firm sheet material that can be folded. FIG. 9 is a plan view of a preferred blank form 50 for manufacturing game chassis 10. The form 50 broadly comprises a generally rectangular central panel 52, left and right wing panels 54L and 54R, left and right leg panels 56L and 56R, a lower panel 58 and a goal panel 60. Form 50 is conveniently formed from a single sheet of material by a known process, such as stamping. Thereafter, it may be formed conveniently into the game chassis 10 as will be explained further below.

Those skilled in the art will appreciate that central panel 52 will provide surface 14 of the finished game chassis 10, and the openings 14*a* therein correspond to the openings 14*a* in surface 14.

The wing panels 54L, 54R are identical mirror images. Accordingly, only panel 54R will be described. At the juncture between panels 52 and 54R, a fold line 60 is provided, along which three rectangular cuts in panel 52 are interspersed. The outer margin 64 of panel 54R forms approximately a 15° angle to fold line 60, so that panel 54R is generally triangular. At the top edge of panel 54R, there is formed a tab 64, which is slightly undercut at 64', 64' along the top edge of the panel 54R. The bottom end 66 of panel 54R is separated from the main panel by a fold line 68, which has a slot 69 formed therein.

The leg panels 56L, 56R are identical mirror images. Accordingly, only panel 56R will be described. Panel 56R is separated from panel 52 by a fold line 70 and has a laterally protruding portion 72 which is separated from the main panel by a fold line 74 including a slit 76, which is somewhat narrower than tab 64. Slit 76 is positioned to be the same distance from fold line 70 that tab 64 is from fold line 74, which permits tab 64 to be inserted within slit 76 when game chassis 10 is assembled, as explained further below.

Lower panel 58 is separated from central panel 52 by a fold line 78, along which there are formed two rectangular cuts 80, 80 in panel 52. On either side of panel 58, a tab 82 protrude laterally and is undercut slightly along fold line 60. Tab 82 is somewhat wider than slit 69 and is positioned to be the same distance from fold line 78 that slit 69 is from fold line 60. This permits tabs 82 to be inserted within slits 69 when game chassis 10 is assembled, as explained further below.

Goal panel 60 is separated from panel 52 by a fold line 84. It will be appreciated that panel 60 comprises the goal 18 with the uprights 18*a*, 18*a*. In addition, a strut element 86 projects between the uprights from a fold line 88. Strut element 86 is formed with an undercut tab 90, which is dimensioned to fit within an undercut slot 92 in panel 52.

The initial step in assembling game chassis 10 is folding down the wing panels 54L and 54R along fold lines 60. This causes the rectangular cutouts 62, 62, 62 to protrude upwardly, forming the small walls 14*b*, 14*b*, 14*b*. Next, lower panel 58 is folded down along the line 78, causing the rectangular cutouts 80, 80 to protrude upwardly, to form the small walls 14*b*, 14*b*. Tabs 82 may then be inserted into slits 69, causing the walls 54L, 58, and 54R to be assembled together. Portion 72 may then be folded down along line 74, panel 56R folded down along line 70, and tab 64 inserted into slits 76, causing leg panel 56R and panel 54R to be joined together. Leg panel 506L may be joined to wing panel 54L the same manner. The entire game chassis 10 is then assembled, except for the goal 18.

To assemble the goal 18, panel 60 is folded upwardly along line 84, strut portion 86 is folded downwardly along line 88, and tab 90 is inserted into slot 92. With the goal so assembled, strut portion 86 assists in supporting goal 18 in an upright position.

Figure 10:
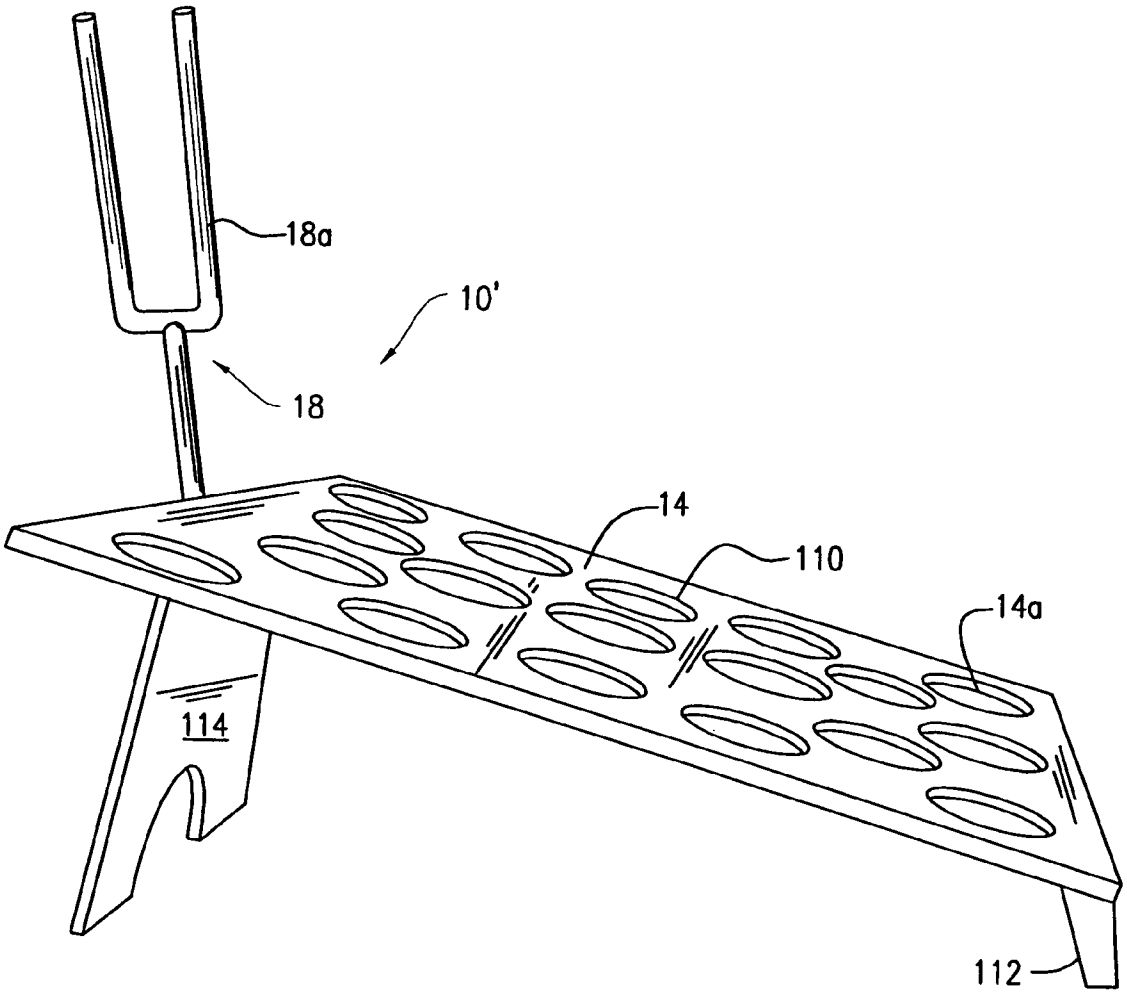
FIG. 10 is a perspective view of a second embodiment of a game chassis in accordance with the present invention.

FIG. 10 is a perspective view of a second embodiment 10' of a game chassis in accordance with the present invention. Game chassis 10' broadly comprises a primary panel 110 supported on a forward incline via a front pedestal 112 and a rear pedestal 114, and a goal assembly 18' projecting upwardly at the rear of chassis 10'. As best seen in FIG. 10, panel 110 has an upper surface 14 which is identical to the surface 14 illustrated in FIG. 3. In this embodiment, the dimensions a generally the same as the dimensions of game chassis 10. Panel 110 is preferably a sheet of plywood, particleboard, or the like. Pedestal 112 is preferably a board and pedestal 114 may similarly be formed from boards or from a sheet of plywood, or the like. Goal assembly 118' is preferably formed of a tubular material and is preferably mounted in a recess in panel 10. Although chassis 10' is illustrated as being made of wooden components 110, 112 and 114, those skilled in the art will appreciate that it could also be made with plastic panels, or the like, or it could be molded as a single element. Chassis 10' would be used in the same way as chassis 10, requiring the use of game pieces and a scoreboard element.

Figure 12:
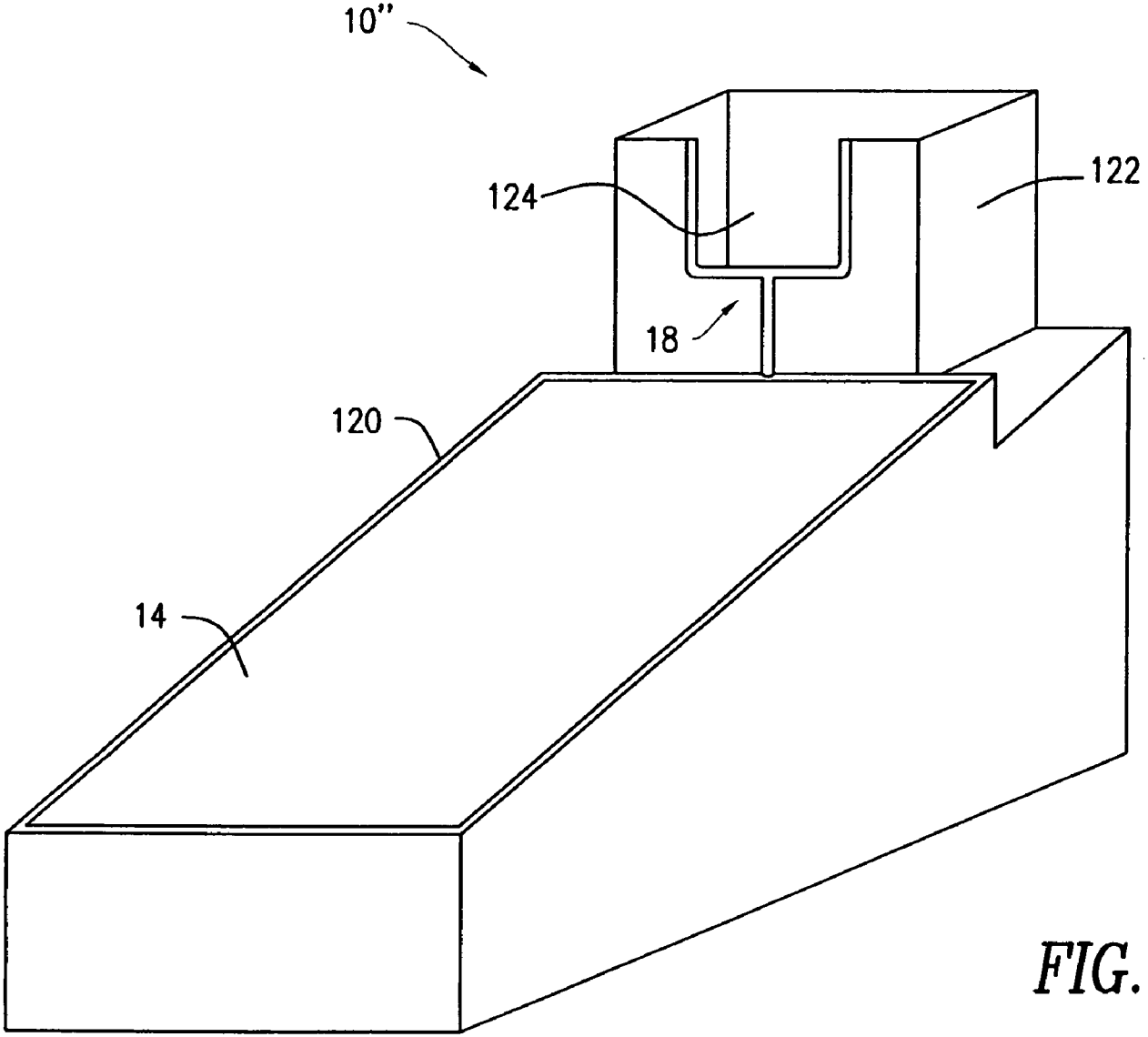
FIG. 12 is a perspective view of a third embodiment of a game chassis in accordance with the present invention.

FIG. 12 is a perspective view of a third embodiment 10" of a game chassis in accordance with the present invention. Whereas the first two embodiments were tabletop models, chassis 10" is a floor model. Accordingly, it is approximately 2 feet wide and 40 inches long. The chassis is also approximately 7 inches high at the front and in 16 inches high at the rear. Chassis 10" has a primary panel 120, defining a plane surface, which is preferably about 2 feet wide and the 3 feet long. At the rear of chassis 10", an upwardly projecting chute 122 defines a goal assembly, and a cutout 124 which is approximately 8 inches high and 5½ inches wide defines the actual goal opening between the uprights. Preferably, chassis 10" is made of wood, but those skilled in the art will appreciate that it could be made of many other materials, including plastic. Also, chassis 10" preferably has a plane surface 14' which is identical to surface 14, except that it is proportionately larger.

Owing to the larger size of game chassis 10", the game pieces are preferably bean bags. Moreover, utilizing a chute for the goal assembly guarantees that a game piece passing between the uprights will be trapped in the chute and fall downwardly, instead of instead of flying beyond the chassis 10". Also owing to the larger size of the chassis, the toss line is preferably at a distance of 15 feet from the chassis. Similarly, an extra point and field goal kick are preferably taken from a line which is 12 feet away from the chassis. Also, for each 10 yards closer (than the 30 yard line) that a field goal attempt is made, a player may toss from a position which is one foot closer to the chassis. Otherwise, the method of play would be identical.

Figure 13:
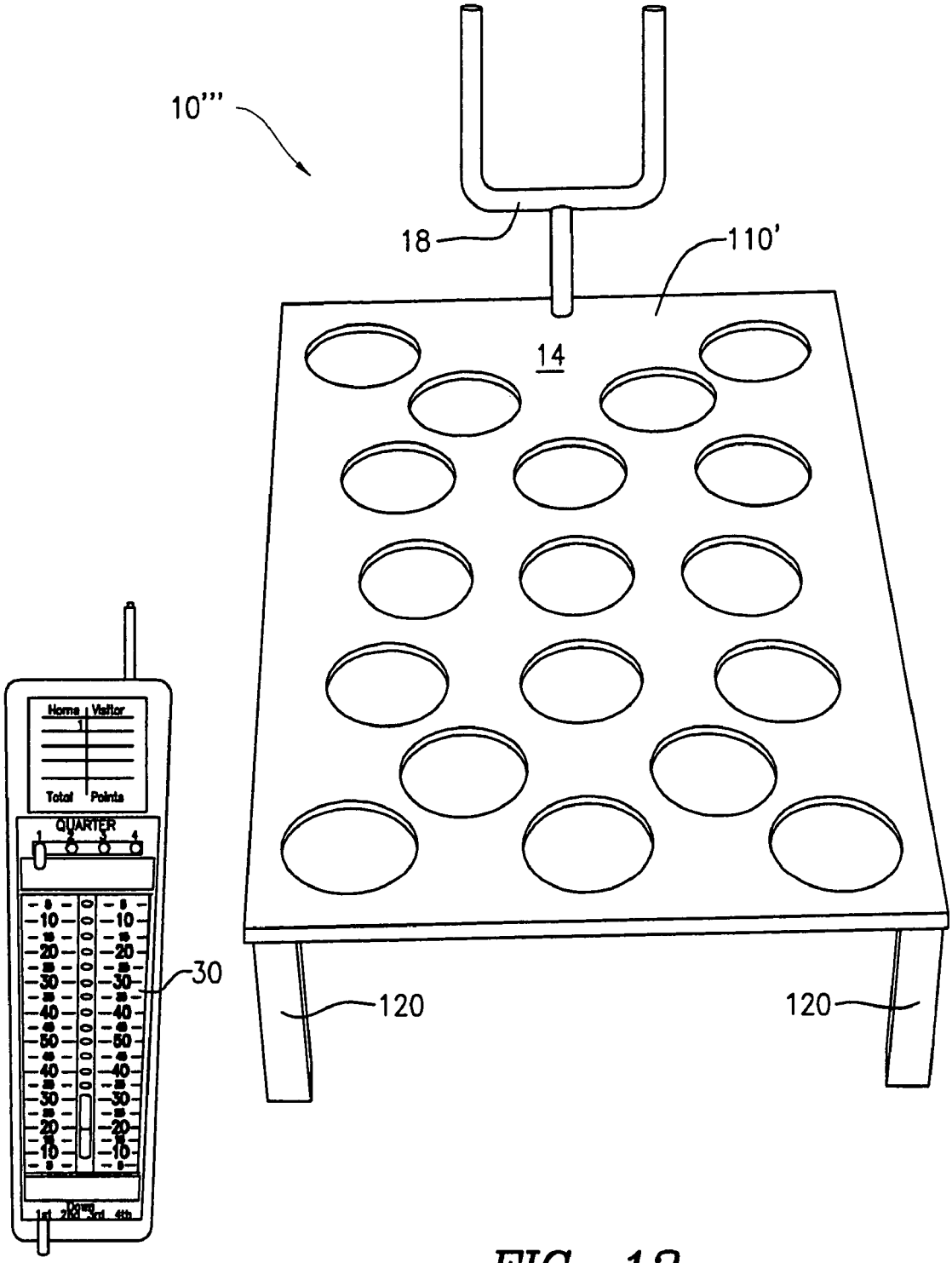
FIG. 13 is a perspective view of a fourth embodiment of a game chassis in accordance with the present invention.

FIG. 13 is a perspective view of a fourth embodiment 10'" of a game chassis in accordance with the present invention. This chassis is a floor model and, therefore, approximately the same size as chassis 10". However, its construction is somewhat similar to the chassis 10'. Specifically, it is formed of a primary panel 110' and four simple legs 120, the rear legs being longer than the front legs to impart a forward tilt to panel 110'. The construction of panel 110' is preferably wood, essentially the same as that of panel 110. The game would be played the same way and would use bean bags for game pieces, as well as a scoreboard of the type already shown. However, those skilled in the art will appreciate that other materials could be used for the construction, such as reinforced plastic panels and molded legs.

Although preferred embodiments of the invention have been disclosed for illustrative purposes, those skilled in the art will appreciate that many additions, modifications, and substitutions are possible without departing from the scope and spirit of the invention as defined by the accompanying claims.

What is claimed:

1. A game to be played manually by a player, comprising:

a playing surface with a plurality of openings dimensioned to receive a game piece;

indicia on the playing surface associating the openings with a point values, the point values being positive and negative, the value of an opening to be scored by the player when he causes a game piece to enter that opening, the indicia being associated with gained and lost yards on a football field and a further opening dimensioned to receive a game piece, the further opening disposed on a playing component having the appearance of a football goal, the further opening being located thereon substantially above the playing surface.

2. The game of claim 1 further comprising a game piece constructed to be tossed at the playing surface from a distance.

3. The game of claim 1 further comprising a scoring element including an indicator of the player's position on a football field and one of: a marker for indicating the field position at which a first down would be achieved; the current quarter of play; and the score, based on the number of touchdowns, points after scores, field goals and safeties scored for and against the player.

4. A game to be played manually by a player, comprising:

a playing surface with a plurality of openings dimensioned to receive a game piece;

indicia on the playing surface associating the openings with a point values, the point values being positive and negative, the value of an opening to be scored by the player when he causes a game piece to enter that opening, and a further opening dimensioned to receive a game piece, the further opening disposed on a playing component having the appearance of a device used in a sports activity, the further opening being spaced from the playing surface, a plurality of template plates dimensioned to cover the playing surface and having openings therein dimensioned to receive a game piece and aligned with openings in the playing surface, a template plate having at least one area overlying and closing off an opening in the playing surface when the template plate is mounted thereon, a template plate having indicia thereon associating the openings therein with point values, the point values being positive and negative, the value of a template plate opening to be scored by the player when he causes a game piece to enter that opening, and a retaining element on one of the playing surface and a template plate constructed to retain the template plate on the playing surface.

5. The game of claim 4 wherein different template plates have areas overlying and closing off different openings in the playing surface when mounted thereon.

6. The game of claim 4 wherein one of the template plates has indicia associated with activities and corresponding scoring in one of:

a game of basketball;

a game of soccer;

a game of golf; and an automobile race.

7. The game of claim 4 further comprising a game piece constructed to be tossed at a template plate from a distance.

8. A game to be played manually by a player, comprising:

a playing surface with a plurality of openings dimensioned to receive a game piece;

at least one template plate dimensioned to cover the playing surface and having openings therein dimensioned to receive a game piece and aligned with openings in the playing surface;

a template plate having at least one area overlying and closing off an opening in the playing surface when the template plate is mounted thereon, a template plate having indicia thereon associating the openings therein with point values, the point values being positive and negative;

the value of a template plate opening to be scored by the player when he causes a game piece to enter that opening; and a retaining element on one of the playing surface and a template plate constructed to retain the template plate on the playing surface.

9. The game of claim 8 wherein different template plates have areas overlying and closing off different openings in the playing surface when mounted thereon.

10. The game of claim 8 wherein one of the template plates has indicia associated with activities and corresponding scoring in one of:

a game of basketball;

a game of soccer;

a game of golf; and an automobile race.

11. The game of claim 8 further comprising a game piece constructed to be tossed at a template plate from a distance.

* * * * *